US007608023B2

(12) United States Patent
Casagrande

(10) Patent No.: US 7,608,023 B2
(45) Date of Patent: Oct. 27, 2009

(54) EXERCISE MACHINE

(75) Inventor: Simone Casagrande, Rimini (IT)

(73) Assignee: Technogym S.p.A., Gambettola (IT)

( * ) Notice: Subject to any disclaimer, the term of this patent is extended or adjusted under 35 U.S.C. 154(b) by 8 days.

(21) Appl. No.: 11/775,805

(22) Filed: Jul. 10, 2007

(65) Prior Publication Data

US 2008/0015094 A1 Jan. 17, 2008

(30) Foreign Application Priority Data

Jul. 11, 2006 (IT) ..... BO2006A0534

(51) Int. Cl.
*A63B 21/062* (2006.01)

(52) U.S. Cl. ..... 482/100; 482/98; 482/99; 482/5

(58) Field of Classification Search ..... 482/5, 482/93, 94, 98–103, 908; *A63B 21/62*
See application file for complete search history.

(56) References Cited

U.S. PATENT DOCUMENTS 1,053,109 A * 2/1913 Reach ..... 482/99
4,546,971 A * 10/1985 Raasoch ..... 482/100
4,610,449 A * 9/1986 Diercks, Jr. ..... 482/98
5,306,221 A * 4/1994 Itaru ..... 482/98
5,350,344 A * 9/1994 Kissel ..... 482/98
5,643,151 A * 7/1997 Naimo ..... 482/98
6,174,265 B1 * 1/2001 Alessandri ..... 482/5
6,206,810 B1 * 3/2001 Alessandri ..... 482/98
7,011,609 B1 * 3/2006 Kuo ..... 482/94
7,364,535 B1 * 4/2008 Rosenow et al. ..... 482/101
2005/0164838 A1 * 7/2005 Watterson et al. ..... 482/54

FOREIGN PATENT DOCUMENTS

EP 0893143 A2 1/1999
EP 1614449 A1 1/2006

* cited by examiner

*Primary Examiner*—Fenn C Mathew
*Assistant Examiner*—Andrew M Tecco
(74) *Attorney, Agent, or Firm*—Pearne & Gordon LLP

(57) ABSTRACT

An exercise machine comprises an element for an application of a force by a user, a plurality of weights for countering the force applied on the element, which can be stacked on one another, a load regulator which in turn comprises a pulling bar, the pulling bar is able to slide in a longitudinal slot and can be associated with the weights and has a plurality of grooves along its longitudinal extension.

20 Claims, 4 Drawing Sheets

EXERCISE MACHINE

BACKGROUND OF THE INVENTION

The present invention relates to an exercise machine, in particular the present invention relates to a load regulator for the weights pack of exercise machines.

As is known, exercise machines are used in many exercises for physical culture or muscle and/or joint rehabilitation.

Such machines consist of a fixed frame, a weights pack, a handle or grip bar, a chain or cable connecting the handle to the weights pack.

The weights pack consists of a plurality of individual weight units consisting of small bricks, usually parallelepipeds.

The weights slide along two rod-shaped guides which are part of the frame in a predetermined direction.

Due to gravity, the weights tend to apply a force towards the ground, opposed by the force applied by the user who, while exercising, counters the force of the weights by cyclically applying a force on the handle which is transmitted to the weights thanks to the tension applied by the cable or by the chain.

In this way, the user lifts the weights during the active step of the exercise.

It is known that most training programs, whether for body-building and therefore to increase muscle mass, or for post-traumatic rehabilitation, involve multiple repetitions of the same exercise, in each of them varying the load to be lifted, that is to say, the effort required of the muscle involved.

For this reason exercise machines must allow the simple, rapid selection and variation of the load at the end of each repetition.

The load is regulated by selecting a predetermined number of small bricks in the weights pack, based on the reaction required of them during the exercise.

In practice, suitable means are used to associate with the cable connected to the handle a number of small bricks predetermined according to the weight to be lifted.

There are prior art machines in which each small brick has a vertical central through-hole and a central through-hole horizontal to the ground.

Said holes are communicating holes and, when the small bricks are stacked on one another, the vertical holes form a channel which receives a rod-shaped bar.

The rod-shaped bar is connected at one end to the cable to which the handle is connected and has a plurality of holes along its longitudinal extension.

When the bar is completely inserted in the channel formed by the vertical holes in the small bricks, each hole in the bar is coaxial with a relative horizontal hole in a small brick.

The desired load is selected manually by inserting a locking pin through a horizontal hole in one of the small bricks and the corresponding hole at the same height in the rod-shaped bar.

In this way, all of the small bricks above the small brick in which the pin is inserted are locked and associated with the bar (and therefore with the cable and the handle).

Moving the pin into one of the small bricks below the selected small brick increases the weight to be lifted because it increases the number of small bricks associated with the bar. Vice versa, inserting the pin in one of the small bricks above the selected small brick reduces the weight to be lifted.

Said machines have the disadvantage of only allowing manual regulation of the load to be applied, greatly limiting their applications which would be possible if electronics were used.

There are machines in which the load of the weights can be regulated automatically using a load selector involving the use of means for coupling the weights to the rod-shaped bar which can adopt a locked position in which they engage on the bar the small brick with which they are associated, and a released position in which the small brick is not pulled together with the bar.

Said means are associated with a belt which can slide in a direction parallel with the bar, resulting in the relative locked or released condition.

Such machines have a certain construction complexity and the sliding belt associated with the coupling means is subject to rapid wear.

SUMMARY OF THE INVENTION

The aim of the present invention is therefore to overcome the above-mentioned disadvantages by providing a load regulator which is effective, economical, easy to regulate and resistant to wear and which allows both manual regulation and automatic regulation of the weight load.

The technical features of the present invention, in accordance with the above aim, are apparent from the content of the claims herein, in particular claim 1 and, preferably, from any of the claims directly or indirectly dependent on claim 1.

BRIEF DESCRIPTION OF THE DRAWINGS

The advantages of the present invention are more apparent in the detailed description which follows, with reference to the accompanying drawings which illustrate a preferred, non-limiting embodiment of the invention, in which.

Figure 2:
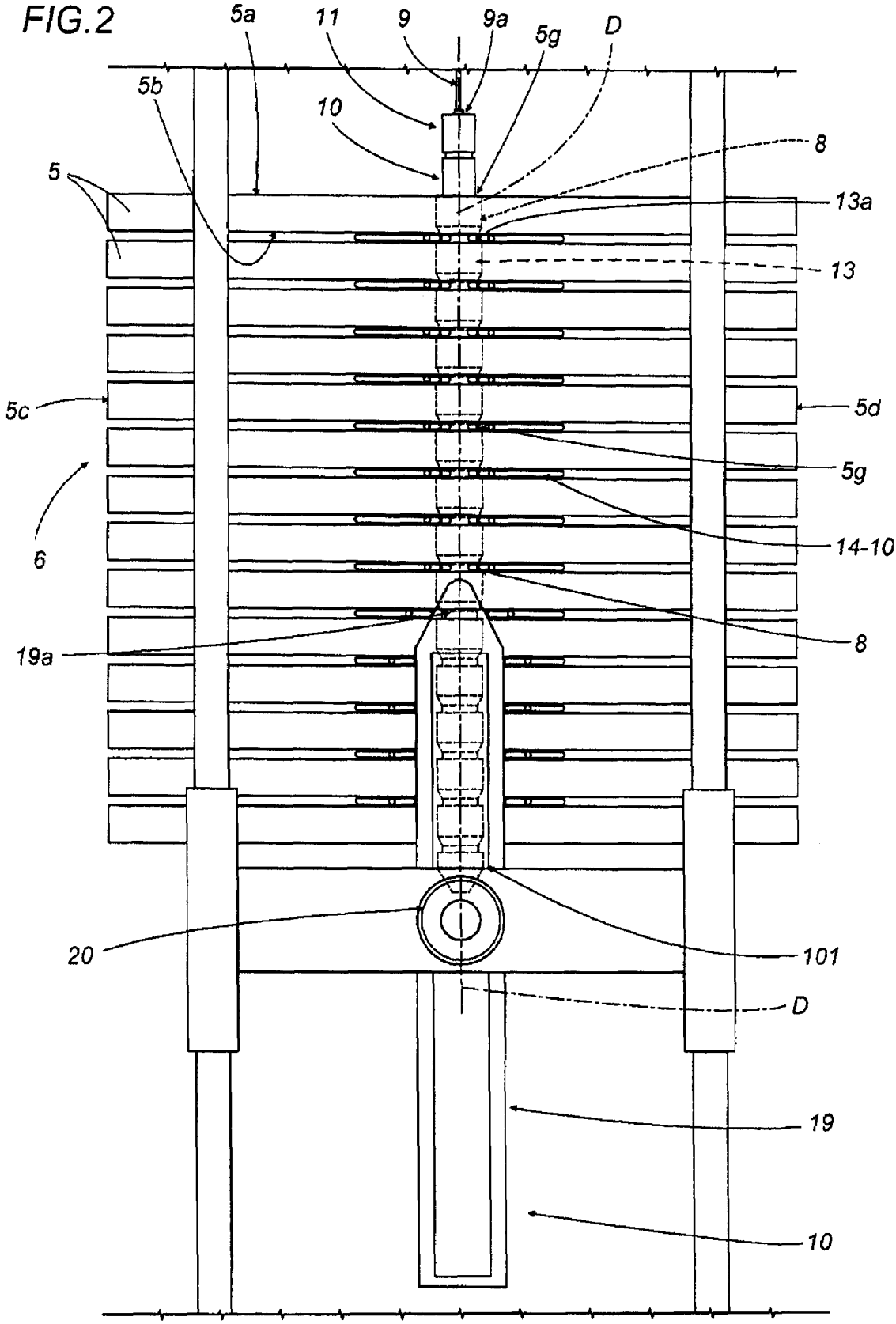
FIG. 2 is a schematic cross-section, with some parts cut away, of a detail of a first embodiment of the exercise machine of FIG. 1.
Figure 6:
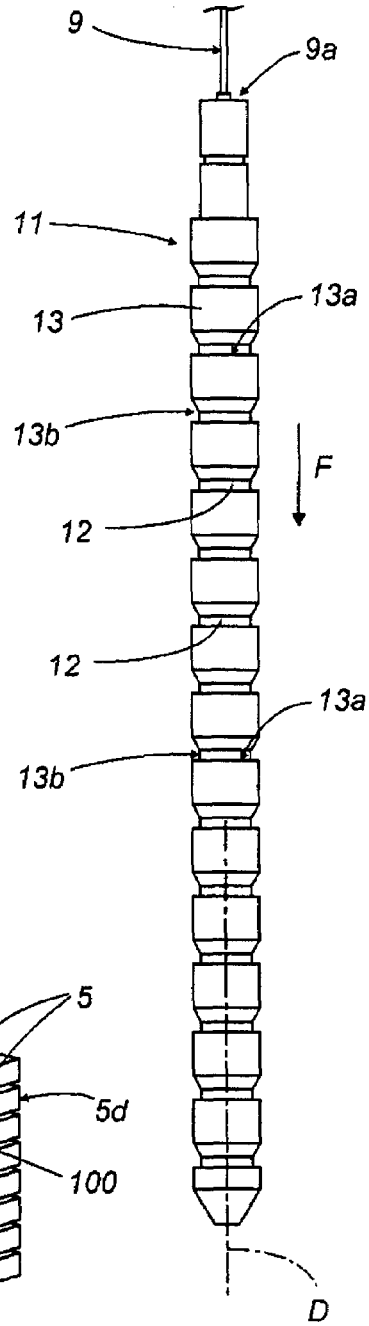
FIG. 6 is a schematic perspective side elevation view of a detail of the machine of FIG. 1.
Figure 7:
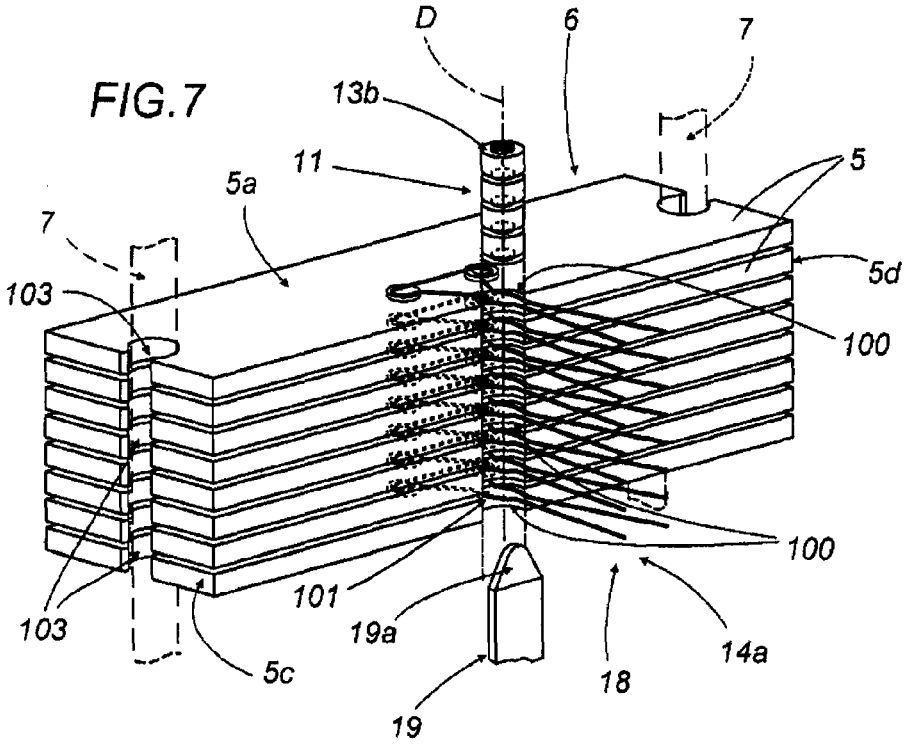

FIG. **6*a* is a schematic cross-section of a detail of another embodiment of the element of FIG. 6**;

FIG. 7 is a schematic perspective side elevation view of another embodiment of the detail from FIG. 2.

DESCRIPTION OF THE PREFERRED EMBODIMENTS

With reference to the accompanying drawings, the numeral 1 denotes an exercise machine made in accordance with the present invention.

The exercise machine 1 comprises a frame 2 forming the basic structure of the machine 1.

Figure 1:
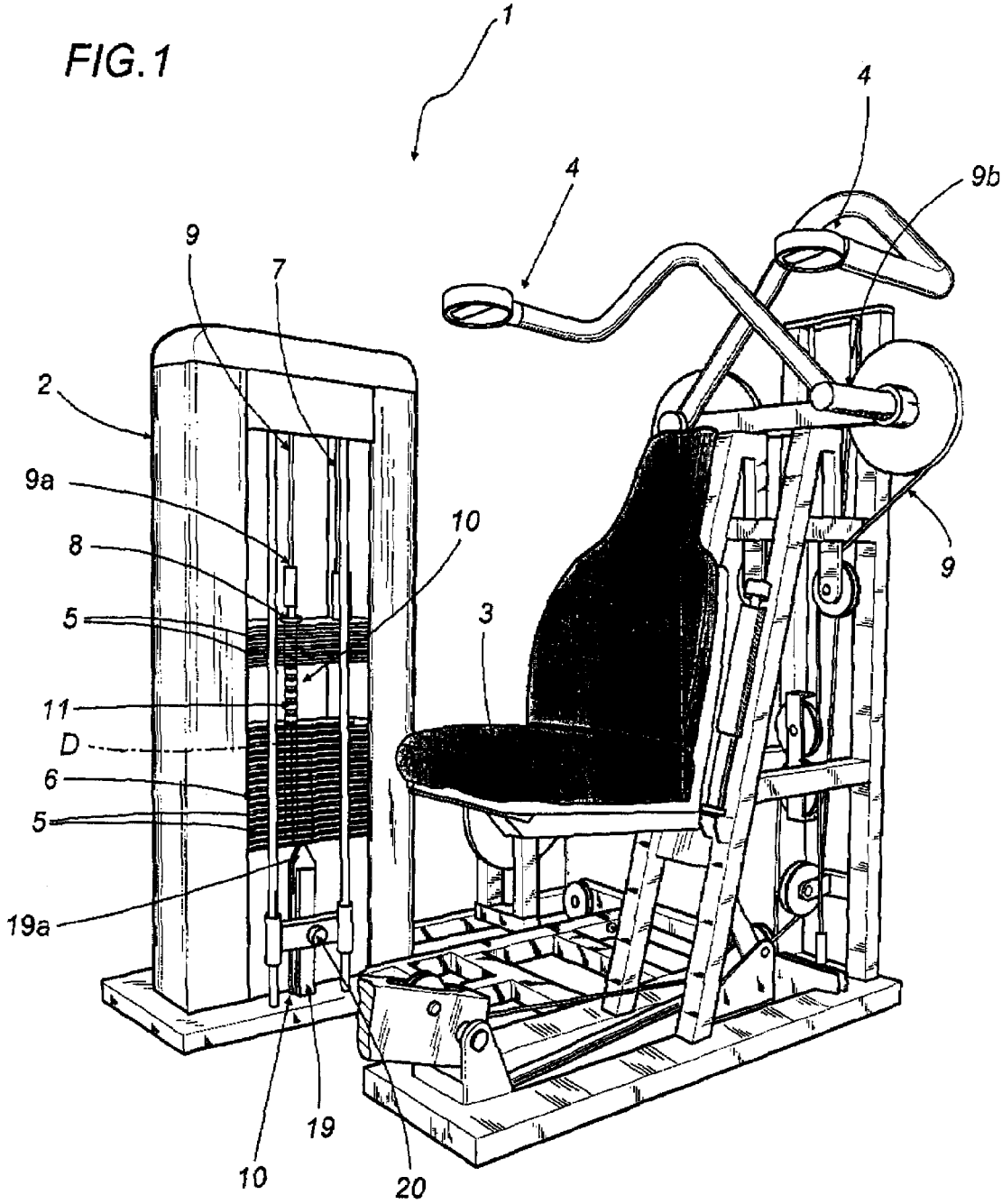
FIG. 1 is a schematic perspective view of an exercise machine in accordance with the present invention.

In the embodiment illustrated in FIG. 1, on the frame 2 there is a seat 3 on which the user positions himself.

Alternatively, according to other possible embodiments of the machine 1, partly dependent on the type of training for which it is intended, the user can also stand in front of the machine 1.

Close to the seat 3 there is an element 4 for allowing the user to apply a force in order to perform the exercise.

Said element 4 may be a handle, a grip bar or any other part suitable for engaging with one or more of the user's limbs.

The machine 1 also comprises a plurality of weights 5 which are also positioned on the machine 1 frame 2.

As illustrated in FIG. 2, the weights 5 substantially have the shape of a parallelepiped, having an upper surface 5*a* and a lower surface 5*b* and they can be stacked on one another to form a weights pack 6.

Figure 4:
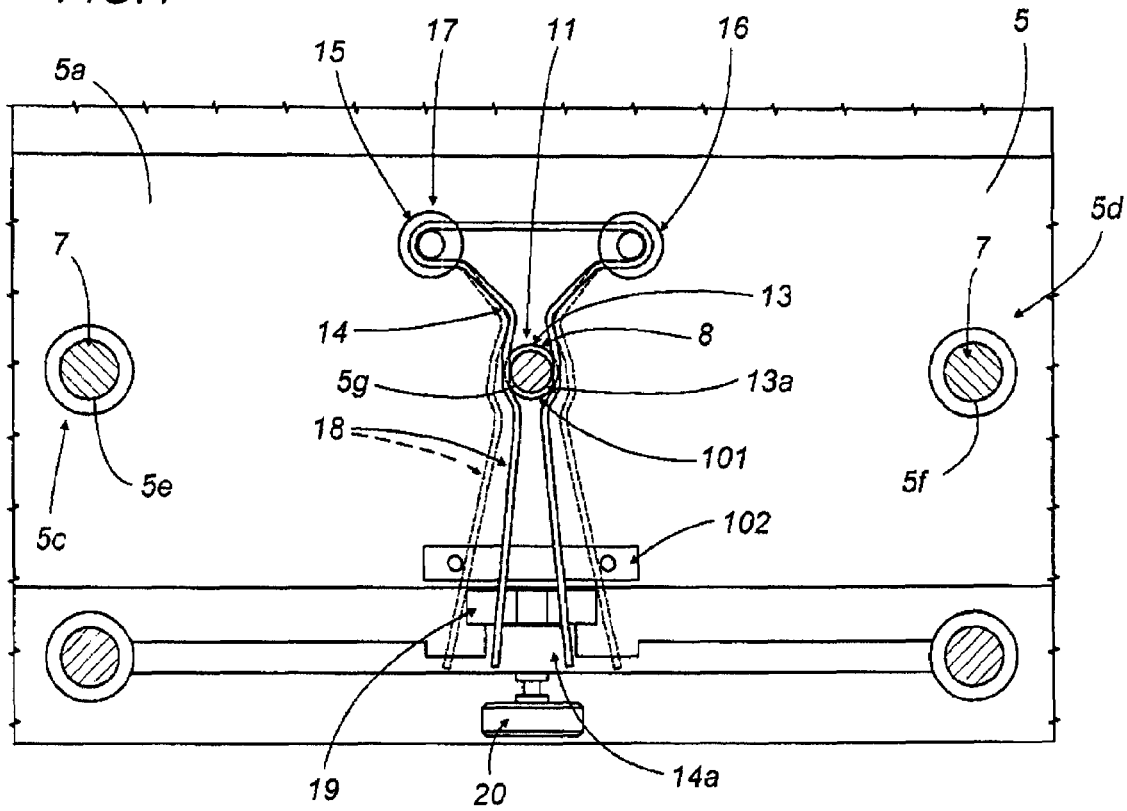
FIG. 4 is a schematic plan view of a detail of the machine made in accordance with the present invention.
Figure 5:
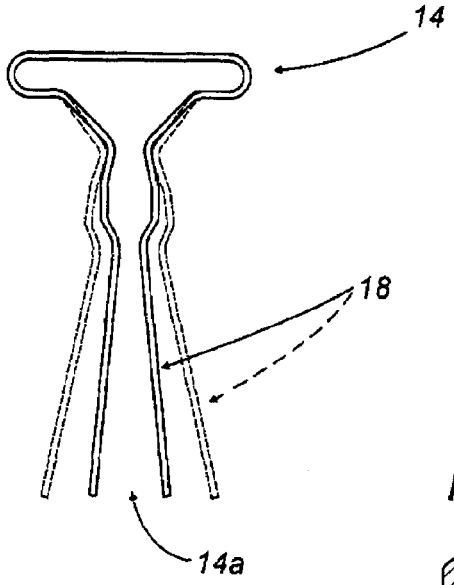
FIG. 5 is a schematic perspective view of an enlarged detail from FIG. 4 in a first and a second operating configuration.

As illustrated in FIG. 4, each weight 5 also has, at its first and second ends 5*c*, 5*d*, a first and a second through-hole 5*e*, 5*f* and, at a central portion, a third through-hole 5*g*.

As illustrated in FIG. 1, the frame 2 comprises two rod-shaped guides 7, extending vertically, along which the weights slide, guided, by means of the holes 5*e*, 5*f*.

Alternatively to the holes 5*e*, 5*f* the weights 5 may have, at the ends 5*c*, 5*d* semi-circular notches 103 in which the rod-shaped guides 7 slide, as illustrated in FIG. 7.

When the weights 5 are stacked on one another, the third through-holes 5*g* in them form a substantially cylindrical channel 8.

According to another possible embodiment illustrated in FIG. 7, alternatively to the central through-holes 5*g*, the weights 5 have a circular open cavity 100, made in one of their sides.

The machine 1 comprises a cable 9 supported, using means of the known type and therefore not described in further detail, by the frame 1 and having a first end and a second end 9*a*, 9*b*.

The second end 9*b* of the cable 7 is connected to the element 4 for application of the force.

The machine 1 also comprises a load regulator 10 for selecting the weights 5.

The regulator 10 comprises a pulling bar 11, connected to the first end 9*a* of the cable 9.

The pulling bar 11 extends longitudinally in a predetermined direction D and has a plurality of grooves 12 along said extension.

Figure 6A:
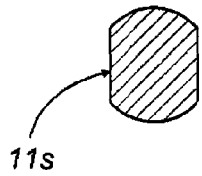

Advantageously, according to the embodiment illustrated in the accompanying drawings the grooves 12 are circular. Alternatively, they may have opposite flat surfaces 11*s* which are parallel with one another (FIG. 6*a*).

According to the preferred embodiment illustrated in FIG. 6, the pulling bar 11 consists of a succession of portions 13 having the shape of a truncated cone with an upper base 13*a* and a lower base 13*b*.

The upper base 13*a* is positioned above the smaller base 13*b*, that is to say, each portion 13 having the shape of a truncated cone has a cross-section which decreases from the top down, with reference to the direction of the arrow F in FIG. 6.

The pulling bar 11 slides in a longitudinal slot 101 forming a passage for the pulling bar 11.

In particular, in a first embodiment illustrated in FIG. 2, the pulling bar 11 can be associated with each individual weight 5 and slides freely in said channel 8 formed by the slot 101.

According to another embodiment illustrated in FIG. 7, the longitudinal slot 101 consists of the succession of the circular cavities 100 in the weights 5.

On each weight 5, fixed at the upper surface 5*a*, there is a substantially "U"-shaped spring 14 with an open end 14*a*.

Each spring 14 is fixed on the respective upper surface 5*a* of the weight 5 by a first rivet and a second rivet 15, 16, as illustrated in FIG. 4.

The rivets 15, 16 are machine 1 fixing means 17 and the springs 14 form elastic connecting means 18 for the regulator 10.

Each spring 14 is wrapped around the pulling bar 11 like a ring and has the open end 14*a* projecting from the upper surface 5*a* of the weight 5 on which it is fixed.

The springs 14 are able to move between a closed, home position, in which they connect the respective weight 5 on which they are fixed to the pulling bar 11 and an open position in which they release the weight 5 from the pulling bar 11.

On the upper surface 5*a* of each weight 5 there are also contact elements 102 for the free ends 14*a* of the springs 14, which define a maximum opening position of the springs 14.

Similarly, according to another embodiment not illustrated, the springs 14 are fixed, by respective rivets and contact elements, on the lower surface 5*b* of each weight.

In the closed position the spring 14 engages with the relative groove 12 in the pulling bar 11 at its height.

When the pulling bar 11 is lifted after the user applies the force, the spring 14, in contact with the lower part of the groove 12, allows connection of the relative weight to which it is fixed, as illustrated in FIG. 1.

The regulator 10 also comprises a selection rod 19 which, as illustrated in FIGS. 1 and 2, is positioned at the side of the weights pack 6 and can move parallel with the direction D of longitudinal extension of the pulling bar 11.

Advantageously, but without limiting the scope of the invention, the selection rod 19 has a tapered end 19*a*, preferably "V"-shaped, and is designed to engage in the open ends 14*a* of the springs 14 to widen them and bring them to the open position.

As illustrated in FIG. 2, in a first embodiment, the selection rod 19 comprises a handgrip 20 for manually moving the selection rod 19.

Figure 3:
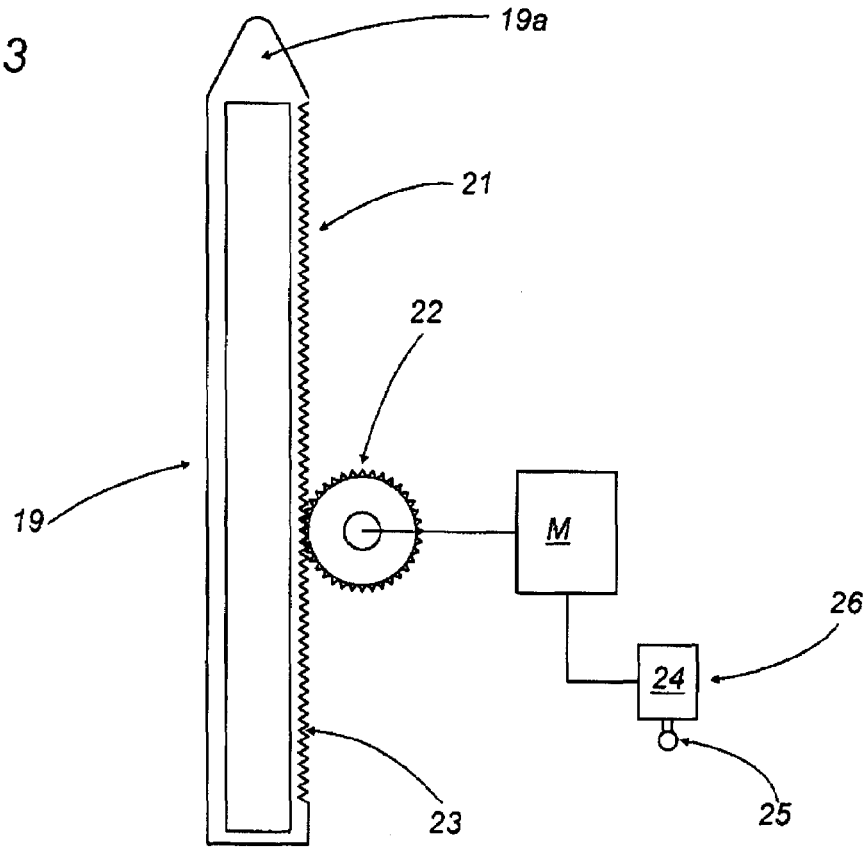
FIG. 3 is a schematic cross-section, with some parts cut away, of a detail of another embodiment of the exercise machine of FIG. 1.

As illustrated in FIG. 3, in another embodiment, the selection rod 19 comprises a rack 21 connected to a roller 22 driven in rotation by a motor M.

The rack 21, the roller 22 and the motor M form selection rod 19 movement means 23.

The motor M is in turn associated with a control unit 24 which can be connected to external peripherals 25 to regulate its programming.

The control unit 24 and the external peripheral 25 are machine 1 electronic means 26.

In practice, the user positions himself close to the machine 1 and sits on the seat 3 in the position required to perform the exercise.

The user inserts the external peripheral 25 (for example, a memory key) in the control unit 24.

Saved in the memory key 25 is the training program for the user with the number of weights 5 to be used in each set on each machine 1.

The control unit 24 receives from the key 25 the information about the load to be set for the first set of the exercise and activates the motor M to move the selection rod 19.

At the moment of starting an exercise, the selection rod 19 is at a predetermined height where it is inside a predetermined number of springs 14 at their free ends 14*a*, widening them and so holding them in the open position.

All of the springs 14 engaged with the selection rod 19 cause the relative weight 5*a* with which they are connected to be released from the pulling bar 11, so that it is not used in the active step of the exercise.

The remaining springs 14, not widened by the selection rod 19, are in a closed position and make the weight 5 on which they are fixed integral with the pulling bar 11 and cause the weight to be lifted with the pulling bar, by the force transmitted by the user through the element 4 and the cable 9 connected to the pulling bar 11.

A precise load is selected based on the information contained in the memory key 25.

If the load to be selected is less than the load selected at the start of the exercise, the control unit 24 activates the motor M so that the motor moves the selection rod upwards, in the direction indicated by the arrow F1 in FIG. 2, thus engaging a greater number of springs 14 which will be brought into the widened position and consequently releasing a greater number of weights 5, reducing the load connected to the pulling bar 11 and the force to be applied by the user to perform the exercise.

Vice versa, if the load to be selected is greater than the load selected at the start of the exercise, the control unit 24 causes selection rod 19 to be moved downwards, in the direction indicated by the arrow F2 in FIG. 2, so that the selection rod 19 disengages from more springs 14, said springs 14 then moving into the closed position and therefore making contact with the groove 12 at their height.

In this way a greater and predetermined number of weights 5 is rendered integral with the pulling bar 11, increasing the load that the user must lift during the exercise.

Advantageously, the load to be lifted in a subsequent set can be increased even while the user is performing the exercise, thanks to the configuration of the pulling bar 11.

If, in the subsequent set additional small bricks 5 must be connected to the pulling bar 11, the control unit 24 moves the selection rod 19 downwards, moving into the closed position a number of springs 14 equal to the number of additional weights 5 to be connected to the pulling bar 11 in the subsequent set.

When the user finishes the current set and lowers the pulling bar 11 with the relative weights 5, the pulling bar 11 slides in the channel formed by the third through-hole in the weights released from it, moving to the lowered position.

During its lowering movement the pulling bar 11 passes through the springs 14 of the weights 5 which in the previous set were not connected to it and amongst these, thanks to its truncated-cone shaped portions 13 with the smaller cross-section at the bottom, it engages with those which during the previous set were moved into the closed position by the selection rod 19, consequently engaging with a respective number of weights 5.

Similarly, if in the subsequent set the weight must be reduced, the selection rod 19 can simply be moved upwards while the user is performing the exercise.

Other embodiments not illustrated involve the use of linkage mechanisms instead of the cable 7, to transmit the force applied by the user on the element 4 to the pack 6 of weights 5 selected.

The invention brings important advantages.

Firstly, the exclusive presence of the elastic means, that is to say, "U"-shaped springs used as means for connecting the weights to the pulling bar on one side allows easy regulation of the load to be set, in manual mode or in automatic mode.

Secondly, the invention allows optimum operation even if electronic control means are used for the load to be lifted, and allows a reduction and increase in the number of weights to be lifted even while the user is using the machine.

Moreover, the use of metal springs allows easy machine operation, significantly reducing wear on the load regulating means.

The invention described above is susceptible of industrial application and may be modified and adapted in several ways without thereby departing from the scope of the inventive concept. Moreover, all details of the invention may be substituted by technically equivalent elements.

What is claimed is:

1. An exercise machine comprising:

an element for the application of a force by a user;

a plurality of weights for countering the force applied on the element, the weights being configured to stack on one another and the weights being connected to the element;

a load regulator comprising a pulling bar, having a longitudinal extension in a predetermined direction, connected to the element, and designed to slide in a longitudinal slot forming a passage for the pulling bar at the plurality of weights, the pulling bar being associated with the weights and the pulling bar having a plurality of grooves along its longitudinal extension, wherein the load regulator comprises elastic means comprising a "U"-shaped spring with an open end, the elastic means being fixed to the weights and able to move between a closed position, in which they connect the weight on which they are positioned to the pulling bar, and an open position in which they release the weight on which they are positioned from the pulling bar; and the regulator comprising a selection rod able to move parallel with the direction, said selection rod being designed to selectively cause the elastic means to adopt respectively the closed or open position, wherein the spring is wrapped around the pulling bar in one of the grooves and the open end is towards the selection rod.

2. The machine according to claim 1, wherein the pulling bar consists of a succession of portions having the shape of a truncated cone with a larger base and a smaller base, the larger base being positioned above the smaller base.

3. The machine according to claim 1, in which the weights substantially have the shape of a parallelepiped and have an upper surface and a lower surface, wherein the weights each comprise means for fixing the elastic means to the weights.

4. The machine according to claim 2, wherein, in the closed position, the spring is in contact with the groove.

5. The machine according to claim 2, wherein each of the springs is fixed on the upper surface of the weight.

6. The machine according to claim 3, wherein the fixing means comprise at least one rivet for fixing the spring to the upper surface of the weight positioned at a curved portion of the spring.

7. The machine according to claim 3, wherein the fixing means comprise a first and a second fixing rivet positioned at said curved portion of the spring.

8. The machine according to claim 1, wherein the open end of the spring is widened when the spring is in the open position.

9. The machine according to claim 1, wherein the selection rod is positioned at the side of the weights pack and the springs have the open end projecting from the respective upper surfaces of the weight with which they are associated so that they are intercepted by the selection rod until they are brought into their open position.

10. The machine according to claim 9, wherein the selection rod is designed to engage with the end of the spring to widen it and bring the spring into the open position.

11. The machine according to claim 8, wherein the spring is in the closed position when the selection rod is disengaged from the end of the spring.

12. The machine according to claim 1, wherein the selection rod comprises a handgrip for manually moving the selection rod along the direction.

13. The machine according to claim 1, comprising means for moving the selection rod.

14. The machine according to claim 13, comprising electronic means associated with the movement means for automatically moving the selection rod.

15. The machine according to claim 13, wherein the movement means comprise a motor, a roller and a rack.

16. The machine according to claim 14, wherein the electronic means comprise a control unit which regulates motor operation.

17. The machine according to claim 14, wherein the electronic means comprise an external peripheral for programming a control unit.

18. The exercise machine according to claim 1, in which the longitudinal slot is a channel formed by corresponding central through-hole portions in the weights, comprising a cable for connecting the weights to the element, the cable having a first and a second end, the second end being connected to the element and the first end being connected to the pulling bar, said pulling bar able to slide in the channel and there being the possibility of associating the pulling bar with the weights.

19. The machine according to claim 1, wherein the grooves are circular.

20. The machine according to claim 1, wherein the selection rod has a tapered end allowing its easy insertion in the open end of the spring.

* * * * *